United States Patent [19]

Winkler

[11] Patent Number: 4,608,897

[45] Date of Patent: Sep. 2, 1986

[54] APPARATUS FOR SEVERING WORK PIECES

[76] Inventor: Alexander Winkler, Ernst-Kahn-Strasse 27, 6000 Frankfurt am Main 50, Fed. Rep. of Germany

[21] Appl. No.: 715,526

[22] Filed: Mar. 25, 1985

[51] Int. Cl.[4] ..... B26D 1/40

[52] U.S. Cl. ..... 83/663; 83/348

[58] Field of Search ..... 83/346, 347, 348, 663

[56] References Cited

U.S. PATENT DOCUMENTS 3,151,513 10/1964 Rowlands ..... 83/348 X
4,366,737 1/1983 Bedford ..... 83/348 X

FOREIGN PATENT DOCUMENTS 6608849 3/1966 Fed. Rep. of Germany .
2405860 10/1979 Fed. Rep. of Germany .
1469684 4/1977 United Kingdom .

*Primary Examiner*—James M. Meister
*Attorney, Agent, or Firm*—W. G. Fasse; D. H. Kane, Jr.

[57] ABSTRACT

An apparatus for severing work pieces, especially paper or foils, has a drum with a cylindrical bore and carrying at least one knife on its circumference. The drum is arranged in a torsionally rigid yet rocking manner on a shaft, which has a cylindrical middle part and adjoining thereto on each end a frustrum-shaped shaft part and then a cylindrical shaft part with elastic compensating members.

2 Claims, 1 Drawing Figure

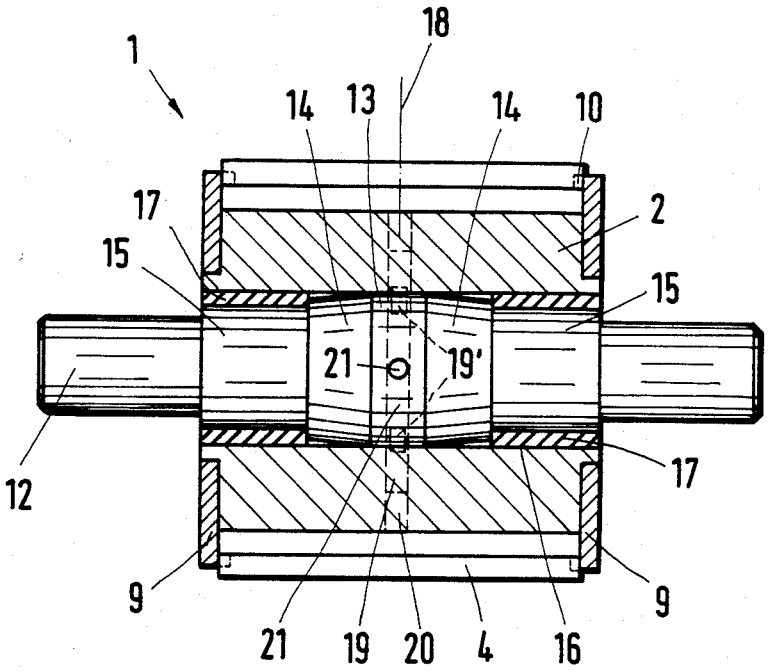
1
18
14
13
14
10
17
2
15
15
21
19'
12
17
9
9
21
19
20
4
16

APPARATUS FOR SEVERING WORK PIECES

FIELD OF THE INVENTION

The invention relates to an apparatus for severing work pieces especially such as paper or foil, by means of a drum which is arranged in a torsionally-rigid, yet rocking manner on a shaft and carries at least one knife on its circumference.

DESCRIPTION OF THE PRIOR ART

An apparatus or drum of this type having four knives on the circumference is shown and described for example in the DE-GM No. 6,608,849. The drum is carried by a shaft, to which a ring is attached by means of a cross-pin. Furthermore, the ring is attached to the drum by short pins arranged at right angles to the cross-pin. One part of the shaft, specifically in the area of the ring, is spherical or ball-shaped, so that the ring and therewith the drum can carry out rocking movements. The essentially Cardanic bearing support of the drum is necessary if, for example, very thin material must be severed. A clean cut may only be achieved if the cutting element or knife severs the material which is to be cut, uniformly over its entire length, i.e., when the knife is properly oriented with respect to the surface of the counter-tool at the moment of cutting. In view of the production tolerances existing in any machine, an exact orientation of the knife to the counter-tool is only achievable in production techniques, if the knife drum is Cardanically supported on a ball-head of the shaft by means of a ring and pins, according to the Utitity Model No. 6,608,849, or if the counter-tools are rockingly arranged on the circumference of a counter-drum as the DE-AS No. 2,405,860 teaches. Here, the counter-tool orients itself corresponding to the respective position of the knife, whereby similarly a clean cut is achieved.

A further possibility of supporting a knife drum in a rocking manner is shown and described in the GB-PS No. 1,469,684. Here the shaft also comprises a ball-shaped middle part, whereby crowned rings likewise rest against the middle part. Sleeves are located at the faces of the rings, whereby the sleeves comprise rubber rings at their outer ends. The rubber rings allow a rocking of the drum on the shaft in a very small range. The production expense and effort is large for a drum produced according to the British patent publication, since many separate parts, namely rings, sleeves and intermediate parts are required. Furthermore, production of the ball-shaped shaft part and the crowned shape of the rings which rest against this shaft part, entails high costs.

OBJECT OF THE INVENTION

The object of the invention is to likewise provide a rocking support of the drum in order to compensate for machine inaccuracies, whereby however much simpler means than previously used are employed.

SUMMARY OF THE INVENTION

The object basic to the invention is achieved in that the shaft comprises a cylindrical middle part which adjoins at each of its ends a frustrum-shaped shaft part and then a cylindrical shaft part with elastic compensating members, whereby furthermore the support bearing bore of the drum is cylindrical. The cylindrical middle part of the shaft serves as the bearing carrier and takes up the forces arising during the cutting operation. The frustrum-shaped shaft parts, which adjoin the middle part at both ends, have no bearing function. They only serve to limit the middle part of the shaft with respect to its length, and to provide a transition to the outer cylindrical shaft parts. The elastic compensating members are arranged on these outer cylindrical shaft parts, and serve to hold the drum in a middle position until the cutting operation, and allow a rocking or yielding of the drum during the cutting operation.

The structural expenditure for such a rocking support is extraordinarily small, since the cylindrical shaft parts as well as the frustrum-shaped shaft parts and the cylindrical bore in the drum may be cost efficiently produced. Furthermore, no special parts in the form of support bearing rings are necessary, as a spherical support would require.

BRIEF DESCRIPTION OF THE DRAWING

In the following, the invention will be more closely described by means of an example embodiment as is shown in the single FIGURE showing a sectional view through a cutting drum of the invention.

DETAILED DESCRIPTION OF A PREFERRED EXAMPLE EMBODIMENT AND OF THE BEST MODE OF THE INVENTION

An apparatus 1 comprises a drum 2 with several knives 4 around its circumference. The knives 4 are secured there by means of end retainer rings 9. Collars 10 protrude from the retainer rings 9 over the knife or knives 4 and secure them in a manner otherwise not more closely described.

To achieve a rocking support of the drum 2 on a shaft 12, this shaft 12 comprises a cylindrical middle part 13 which adjoins at each of its ends a frustrum-shaped shaft part 14 and then a cylindrical shaft part 15. A support bearing bore 16 of the drum 2 is fitted to the outer diameter of the cylindrical middle part 13 of the shaft 12, so that upon insertion of the shaft 12, the drum 2 rests on the cylindrical middle part 13. Elastic compensating members 17 are located between the bearing bore 16 and the cylindrical shaft parts 15. These elastic compensating members 17 allow a rocking of the drum 2 about the radial central plane 18 of the cylindrical middle part 13 of the shaft 12. The compensating members 17 may be springs, rubber members, or other somewhat resilient members.

The securing of the drum 2 on the shaft 12 is achieved by means of pin-shaped dogs 19, which lie in radially extending bores 20 of the drum 2 and in radially extending bores 21 of the shaft 12, whereby these dogs 19 connect the drum 2 to the shaft 12 in a torsionally substantially rigid manner. However, as shown in the drawing, the radially inner ends 19' of the dogs 19 have a diameter smaller than the inner diameter of the bores 21 into which these ends 19' reach. Therefore, torque can be transmitted between the shaft 12 and the drum 2 but the above mentioned rocking is possible due to the smaller diameter of the end 19' providing the required play for said rocking.

Since the shaft must be inserted into the bore of the drum-shaped knife carrier, and according to the demands of the task, the drum shall rock on the shaft, an appropriate fit is stringently necessary. The fit used in practice for the bore 16 is H 7 (between 0 and 0.030 mm) and for the shaft middle part 13 is g 5 (between 0.010 and 0.023 mm). This fit is very tight, but may also be somewhat larger. The values of H 7 and g 5 are therefore not imperative.

Although the invention has been described with reference to specific example embodiments, it will be appreciated, that it is intended to cover all modifications and equivalents within the scope of the appended claims.

I claim:

1. An apparatus for severing work pieces, especially paper or foils, comprising shaft means, a drum having a cylindrical bearing bore (16), means mounting said drum with its cylindrical bearing bore in a torsionally rigid yet rocking manner on said shaft means, at least one knife carried on a circumference of said drum, said shaft means (12) comprising a cylindrical middle part (13), a frustum-shaped part (14) adjoining each side of said middle part, a cylindrical shaft part (15) adjoining each frustum-shaped shaft part, and an elastic compensating member (17) on each cylindrical shaft part (15) for permitting a rocking movement of said drum relative to said shaft means.

2. The apparatus of claim 1, wherein said mounting means comprise dogs (19) operatively interposed between said shaft means and said drum with play for permitting said rocking movement.

* * * * *